US009054403B2

(12) United States Patent
Blanton et al.

(10) Patent No.: US 9,054,403 B2
(45) Date of Patent: Jun. 9, 2015

(54) COAXIAL-TO-STRIPLINE AND STRIPLINE-TO-STRIPLINE TRANSITIONS INCLUDING A SHORTED CENTER VIA

(75) Inventors: Clifford E. Blanton, Tucson, AZ (US); Benjamin L. Cannon, Tucson, AZ (US); Kelly R. Stewart, Tucson, AZ (US); Jared Jordan, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 324 days.

(21) Appl. No.: 13/529,233

(22) Filed: Jun. 21, 2012

(65) Prior Publication Data

US 2013/0342280 A1 Dec. 26, 2013

(51) Int. Cl.

| | |
|---|---|
| ***H01P 5/02*** | (2006.01) |
| ***H01P 1/04*** | (2006.01) |
| ***H01P 5/08*** | (2006.01) |

(52) U.S. Cl.

CPC *H01P 5/02* (2013.01); *H01P 1/047* (2013.01); *H01P 5/085* (2013.01)

(58) Field of Classification Search

CPC ..... H01P 1/047; H01P 5/02; H01P 5/085
USPC ..... 333/33
See application file for complete search history.

(56) References Cited

U.S. PATENT DOCUMENTS

| | | | | |
|---|---|---|---|---|
| 3,757,272 | A | 9/1973 | Laramee et al. | |
| 3,895,435 | A | 7/1975 | Turner et al. | |
| 4,494,083 | A | 1/1985 | Josefsson et al. | |
| 4,816,791 | A | 3/1989 | Carnahan et al. | |
| 5,963,111 | A | 10/1999 | Anderson et al. | |
| 6,566,988 | B2 * | 5/2003 | Muzutani et al. | 333/219 |
| 2006/0125573 | A1 * | 6/2006 | Brunette et al. | 333/33 |
| 2007/0018752 | A1 | 1/2007 | Miller | |
| 2011/0279195 | A1 * | 11/2011 | Kushta et al. | 333/136 |

* cited by examiner

*Primary Examiner* — Stephen E Jones
*Assistant Examiner* — Scott S Outten
(74) *Attorney, Agent, or Firm* — Cantor Colburn LLP

(57) ABSTRACT

A stripline includes a first ground plane; a second ground plane; a first signal trace located between the first ground plane and the second ground plane; and a center via that extends through the stripline and is in electrical contact with the first ground plane and the first signal trace.

19 Claims, 7 Drawing Sheets

COAXIAL-TO-STRIPLINE AND STRIPLINE-TO-STRIPLINE TRANSITIONS INCLUDING A SHORTED CENTER VIA

BACKGROUND

The present disclosure relates generally to coaxial-to-stripline transitions and stripline-to-stripline transitions, and more particularly coaxial-to-stripline and stripline-to-stripline transitions including a shorted center via.

Coaxial-to-stripline and stripline-to-stripline transitions are often used in both radiating and non-radiating electromagnetic (EM) devices, for example, radar seeker antennas and circuit card assemblies. These EM devices may contain one or more layers of a stripline transmission line medium and one or more sections of a coaxial transmission line medium. EM energy inside these devices may be channeled throughout the assembly via one or more stripline-to-stripline or coaxial-to-stripline transitions. These transitions must couple electromagnetic energy smoothly between stripline layers and from the stripline layers to the coaxial mediums with relatively low energy loss and a low incidence of reflections at the desired operating frequencies.

Some coupling mechanisms for stripline-to-coaxial and stripline-to-stripline transitions may require manufacturing techniques that are relatively labor intensive and time consuming, or that may require detailed assembly. For example, blind-plated and buried-plated vias located within a stripline may be used, which require relatively precise manufacturing techniques and tolerances. Laser ablation techniques may be used to form such blind or buried vias; however, this process is not capable of achieving the same aspect ratios as plated through vias, and further requires an additional manufacturing step. Back-drilling and filling techniques may also be used to turn a through via into either a blind or a buried via. However, drill depth can be difficult to control, which may leave stubs that may de-tune the transition. Therefore, the formation of blind or buried vias may be a relatively expensive, complex process and may not be capable of meeting the positional tolerances and aspect ratios that may be achieved by through vias.

SUMMARY

In an exemplary embodiment, a stripline includes a first ground plane; a second ground plane; a first signal trace located between the first ground plane and the second ground plane; and a center via that extends through the stripline and is in electrical contact with the first ground plane and the first signal trace.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
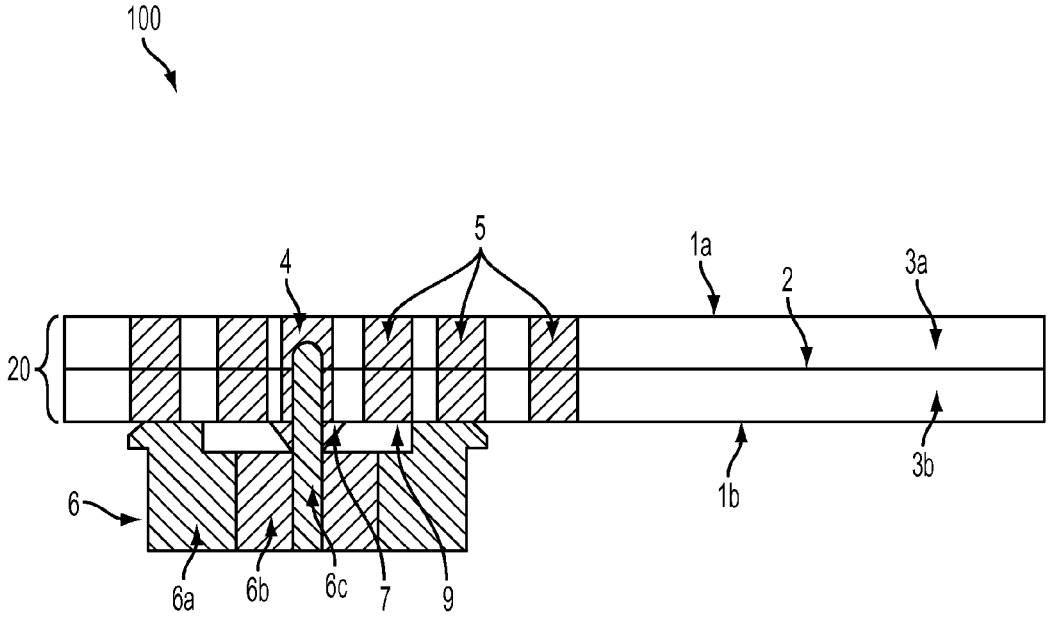
FIG. 1 is a cross-section of an embodiment of a coaxial-to-stripline transition including a shorted center via.

Embodiments of coaxial-to-stripline and stripline-to-stripline transitions including a shorted center via are provided, with exemplary embodiments being discussed below in detail. The center via, through which electromagnetic energy is transmitted between a coaxial center pin and a signal trace in a coaxial-to-stripline transition, or between two signal traces in a stripline-to-stripline transition, is in electrical contact with a ground plane of a stripline, causing a direct short to ground at direct current (DC). The center via is located within a tuning pad of the signal trace that is surrounded by a plurality of mode suppression vias that short the top and bottom ground planes of the stripline together, such that the top and bottom ground planes of the stripline as well as the center via and the stripline are all at the same DC potential during operation. The mode suppression vias are arranged around the tuning pad in a tapered configuration, which ensures broadband transmission of electromagnetic energy through the transition with relatively low return loss. Embodiments of such transitions including a shorted center via may provide broadband electromagnetic energy transmission at relatively high frequencies, such as, for example, the Ka band, which is from about 26 gigahertz (GHz) to about 40 GHz, and may be used for antenna systems or any other appropriate electromagnetic devices. A transition including a center via forming a DC short with the stripline ground plane couples electromagnetic energy smoothly between stripline layers, and from the stripline layers to the coaxial medium, with relatively low energy loss and reduced incidence of reflections over a wide bandwidth at high frequencies.

In some embodiments, the coaxial-to-stripline and stripline-to-stripline transitions having a shorted center via may be formed using standard printed circuit board technology. The center via and mode suppression vias may comprise mechanically drilled plated-through-holes, or plated-through-vias, that extend through the entire stripline, which may reduce complexities in manufacturing by reducing the number of required manufacturing steps. Additional manufacturing processes associated with buried or blind center vias, such as laser-ablation or back-drilling and filling, may be thereby avoided. The transition with the shorted center via also allows routing of additional signal traces in additional striplines directly above the one or more striplines that include the transition with the shorted center via. For example, a multilayer board may include more than two striplines stacked on top of one another, with a transition including a shorted center via included in one or two of the stacked striplines. The additional signal traces in the additional striplines may operate without interference from the transition, as no etched clearance is required on the outer ground plane of the stripline(s) that includes the transition with the shorted center via. In some embodiments, vias, including the shorted center via and mode supression vias, in a single stripline assembly may be drilled and plated before final bonding to other striplines to form a multilayer board. In other embodiments, a plurality of striplines may be bonded together first, and a single drill & plate cycle may be performed after bonding, in which all the bonded striplines are drilled through at once. In such an embodiment, signal traces may be routed around vias on unused layers, which may require additional space for routing of the signal traces; however, this need for additional space may be offset by the reduction in manufacturing steps, depending on the application for which the multilayer board is used.

FIG. 1 illustrates an embodiment of a coaxial-to-stripline transmission system 100 including a shorted center via 4. Stripline 20 includes a top ground plane 1*a*, signal trace 2, and bottom ground plane 1*b*, separated by dielectric core regions 3*a-b*. Center via 4 is shorted to top ground plane 1*a*. Coaxial connector 6 includes an outer shroud 6*a* and a connector dielectric region 6*b* surrounding a center pin 6*c*. The connector dielectric region 6*b* may comprise glass or air in various embodiments. Air gap 9 is located between the coaxial connector 6 and the bottom of stripline 20. The center pin 6*c* is inserted into center via 4 in the stripline 20. To ensure good electrical contact between the center pin 6*c* and the center via 4, the center pin 6*c* is soldered to an etched pad with an annular clearance in the bottom ground plane 1*b* layer via a solder fillet 7. The solder fillet 7 may be replaced by a conductive epoxy or a press-fit configuration in some embodiments. Electromagnetic energy is transmitted by the center via 4 between the center pin 6*c* and the signal trace 2 at the operating frequencies of interest. The center via 4 is surrounded by a plurality of mode suppression vias 5, which are shorted to the top and bottom ground planes 1*a* and 1*b*. Top and bottom ground planes 1*a* and 1*b* are therefore at the same DC potential during operation of system 100, as is signal trace 2 due to the connection to top ground plane 1*a* through center via 4. The mode suppression vias 5 may comprise mechanically drilled plated-through-holes, or plated-through-vias, that extend through the entire system 100, which may reduce complexities in manufacturing. Top and bottom ground planes 1*a-b*, signal trace 2, center via 4, mode suppression vias 5, and center pin 6*c* may comprise any appropriate electrically conductive material, such as copper.

Figure 2:
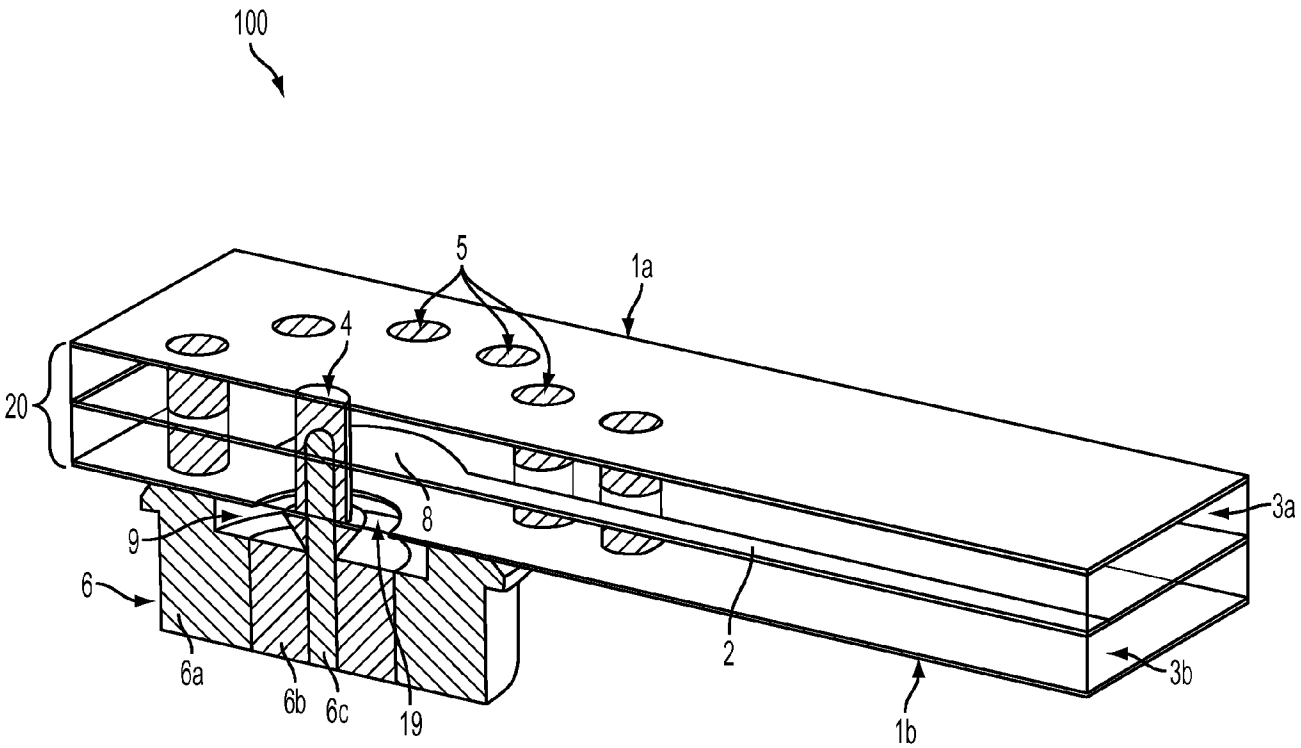
FIG. 2 is a rotated view of a coaxial-to-stripline transition including a shorted center via such as was shown in FIG. 1.
Figure 3:
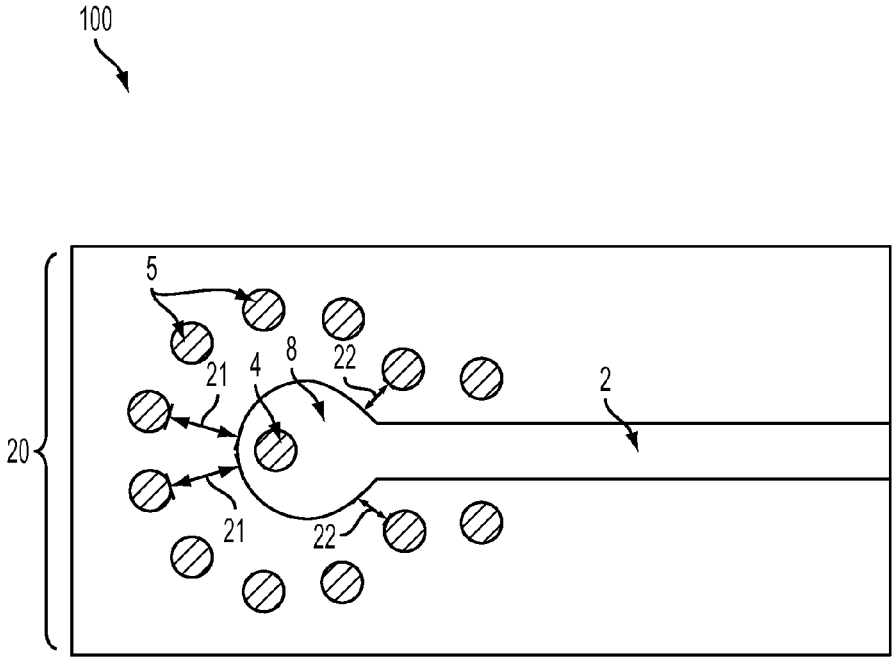
FIG. 3 is a top view of a coaxial-to-stripline transition including a shorted center via such as was shown in FIG. 1.

FIG. 2 illustrates a rotated view of the coaxial-to stripline transmission system 100 including a shorted center via 4 as was shown in FIG. 1. Stripline 20, with top and bottom ground planes 1*a-b* and signal trace 2 separated by dielectric core regions 3*a-b,* with center via 4 shorted to top ground plane 1*a*. The center pin 6*c* of coaxial connector 6 is inserted into center via 4 in the stripline 20, and electromagnetic energy is transmitted by the center via 4 between the center pin 6*c* and the signal trace 2, through the annular clearance 19 in the bottom ground plane 16*b*, at the operating frequencies of interest. Center via 4 is located within and makes contact to a tuning pad 8 of the signal trace 2. Tuning pad 8 is located at an end of signal trace 2. Mode suppression vias 5 surround the tuning pad 8 and center via 4. The mode suppression vias 5 are arranged in a tapered configuration surrounding center via 4 and tuning pad 8. The tapered shape of the tuning pad 8 and tapered configuration of the mode suppression vias 5 is configured for relatively good transmission of electromagnetic energy through the transmission system 100 at the operating frequencies of interest. The mode suppression via configuration and tuning pad shape are illustrated in FIG. 3, which shows a top view of the coaxial-to stripline transmission system 100 including a shorted center via 4 as was shown in FIGS. 1 and 2. Center via 4 is located within a tuning pad 8 of signal trace 2, and tuning pad 8 is surrounded by mode suppression vias 5. The distance between the mode suppression vias 5 and the tuning pad 8 gradually changes from the top of the tuning pad 8 to the bottom of tuning pad 8, as illustrated by distances 21 and 22. As shown in FIG. 3, distance 21 between the mode suppression vias 5 and the tuning pad 8 at the top of tuning pad 8 (i.e., farther away from the signal trace 2) is greater than distance 22 between the mode suppression vias 5 and the tuning pad 8 at the bottom of tuning pad 8 (i.e., closer to the signal trace 2). In the embodiment shown in FIG. 3, distance 21 and distance 22 are configured for broadband transmission system; however, in embodiments in which the system 100 is used for narrowband transmission system, different values for distance 21 and 22 may be used while maintaining a tapered configuration. For example, in an embodiment that is used in a narrowband transmission system, distance 21 may be less than distance 22. A narrowband coaxial-to-stripline transition that does not include tapered mode suppression vias and that operates in the Ka frequency band may have a 2:1 voltage standing wave ratio (VSWR) bandwidth of less than about 10%, while a coaxial-to-stripline transition having tapered mode suppression vias 5 such as are shown in FIG. 3 may provide a 2:1 VSWR bandwidth of over about 60% in some embodiments.

Figure 4:
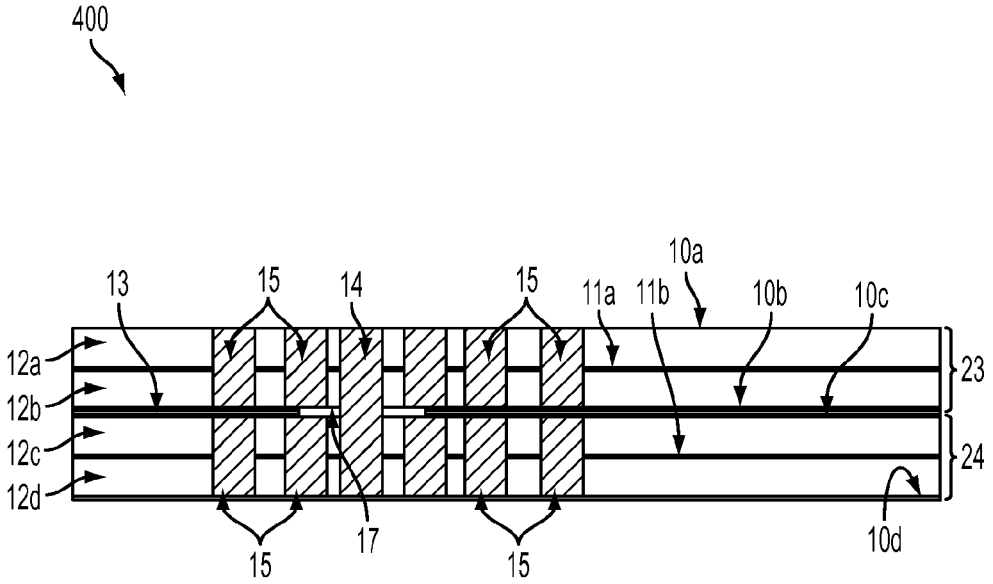
FIG. 4 is a cross-section of an embodiment of a stripline-to-stripline transition including a shorted center via.

FIG. 4 illustrates an embodiment of a system 400 comprising a stripline-to-stripline transition including a shorted center via 14. Two striplines 23 and 24 are shown in FIG. 4. Stripline 23 includes ground planes 10*a-b* and signal trace 11*a*, separated by dielectric core regions 12*a-b*. Stripline 24 includes ground planes 10*c-d* and signal trace 11*b*, separated by dielectric core regions 12*c-d*. Striplines 23 and 24 are connected by bondfilm 13, which is located between ground plane 10*b* on stripline 23 and ground plane 10*c* on stripline 24. Center via 14 transmits electromagnetic energy between signal trace 11*a* in stripline 23 and signal trace 11*b* in stripline 24 through window 17. Center via 14 passes through both of striplines 23 and 24, and is shorted to ground plane 10*a* in stripline 23 and to ground plane 10*d* in stripline 24. A window 17 in ground planes 10*b-c* isolates center via 14 from ground planes 10*b-c* and forms a brief coaxial section with center via 14 and groundplanes 10*b-c* between the stripline 23 and stripline 24. The center via 14 is surrounded by a plurality of mode suppression vias 15 that extend through striplines 23 and 24. Mode suppression vias 15 are shorted to ground planes 10*a-d* such that ground planes 10*a-d* are at the same DC potential during operation. The center via 14 and mode suppression vias 15 may comprise mechanically drilled plated-through-holes, or plated-through-vias, that extend through the entire system 400, which may reduce complexities in manufacturing. Ground planes 10*a-d*, signal traces 11*a-b*, center via 14, and mode suppression vias 15 may comprise any appropriate electrically conductive material, such as copper.

Figure 5:
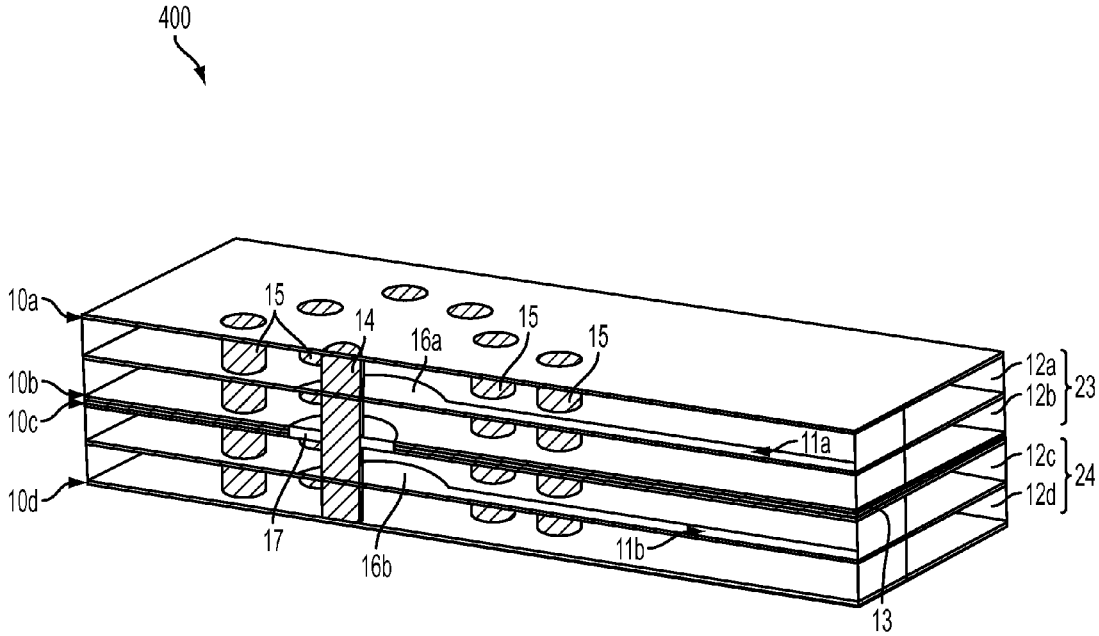
FIG. 5 is a rotated view of a stripline-to-stripline transition including a shorted center via such as was shown in FIG. 4.
Figure 6:
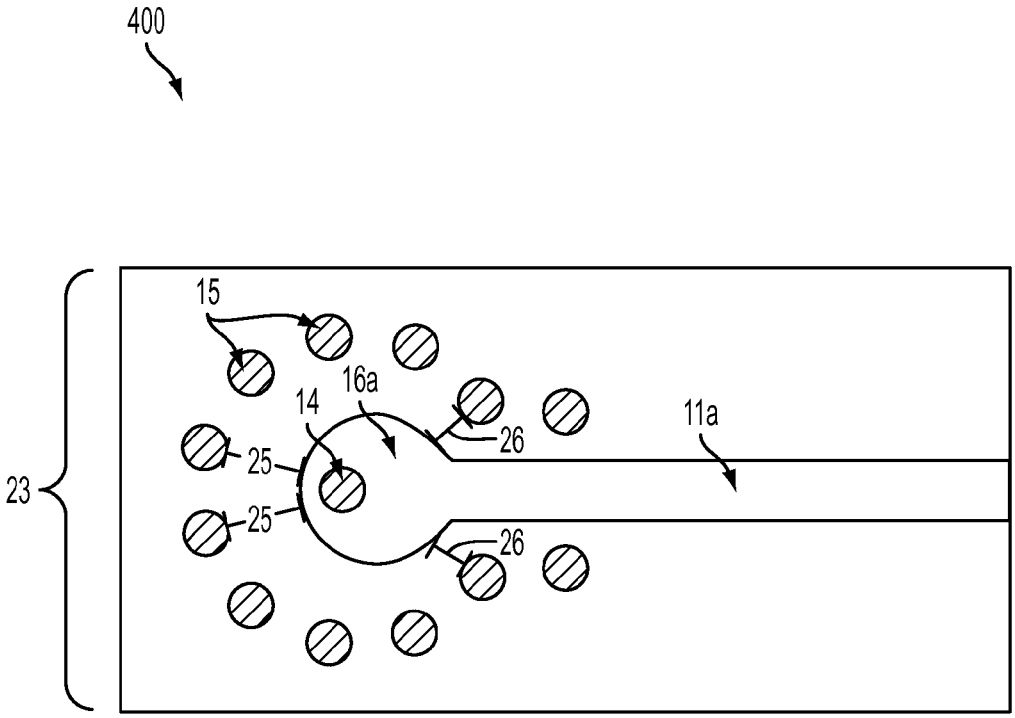
FIG. 6 is a top view of a stripline-to-stripline transition including a shorted center via such as was shown in FIG. 4.

FIG. 5 illustrates a rotated view of the stripline-to-stripline transmission system 400 including a shorted center via 14 as was shown in FIG. 4. Stripline 23, with ground planes 10*a-b* and signal trace 11*a* separated by dielectric core regions 12*a-b*, and stripline 24, with ground planes 10*c-d* and signal trace 11*b* separated by dielectric core regions 12*c-d*, are shown in FIG. 5. Center via 14 is shorted to ground planes 10*a* and 10*d,* and electromagnetic energy is transmitted by the center via 14 between signal traces 11*a-b.* Center via 14 is located within and makes contact to tuning pad 16*a* in signal trace 11*a* and tuning pad 16*b* of signal trace 11*b*. Tuning pads 16*a-b* are each located at an end of respective signal traces 11*a-b*. Mode suppression vias 15 surround the tuning pads 16*a-b* and center via 14. The mode suppression vias 15 are arranged in a tapered configuration surrounding center via 14 and tuning pads 16*a-b*. This tapered mode suppression via configuration is illustrated in FIG. 6, which shows a top view of the stripling-to-stripline transmission system 400 including a shorted center via 14 as was shown in FIGS. 4 and 5. In stripline 23, center via 14 is located within tuning pad 16*a* of signal trace 11*a*, and tuning pad 16*a* is surrounded by mode suppression vias 15. The distance between the mode suppression vias 15 gradually changes from the top of the tuning pad 16*a* to the bottom of tuning pad 16*a*, as illustrated by distances 25 and 26. Distance 25 between the mode suppression vias 15 and the tuning pad 16*a* at the top of tuning pad 16*a* (i.e., farther away from signal trace 11*a*) is greater than distance 26 between the mode suppression vias 15 and the tuning pad 16*a* at the bottom of tuning pad 16*a* (i.e., closer to the signal trace 11*a*). In the embodiment shown in FIG. 6, distance 25 and distance 26 are configured for a broadband transmission system; however, in embodiments in which the transition system 400 is used for a narrowband transmission system, different values for distance 25 and 26 may be used while maintaining a tapered configuration. For example, in an embodiment that is used in a narrowband transmission system, distance 25 may be less than distance 26. Also, while FIG. 6 illustrates stripline 23, with signal trace 11*a*, tuning pad 16*a*, and mode suppression vias 15, the mode suppression vias 15 of stripline 24 may also be arranged in the same tapered configuration with respect to signal trace 11*b* and tuning pad 16*b*. A narrowband stripline-to-stripline transition that does not include tapered mode suppression vias and that operates in the Ka frequency band may have a 2:1 VSWR bandwidth of less than about 10%, while a stripline-to-stripline transition having tapered mode suppression vias 15 such as are shown in FIG. 6 may provide a 2:1 VSWR bandwidth of over about 50% in some embodiments.

A coaxial-to-stripline transition including a shorted center via such as is shown in FIGS. 1-3 may comprise part of a system that additionally includes a stripline-to-stripline transition including a shorted center via in some embodiments. For example, two coaxial-to-stripline transitions with shorted center vias such as system 100 may be bonded together face-to-face without connectors to form a single stripline-to-stripline transition such as system 400 as shown in FIGS. 4-6.

Figure 7:
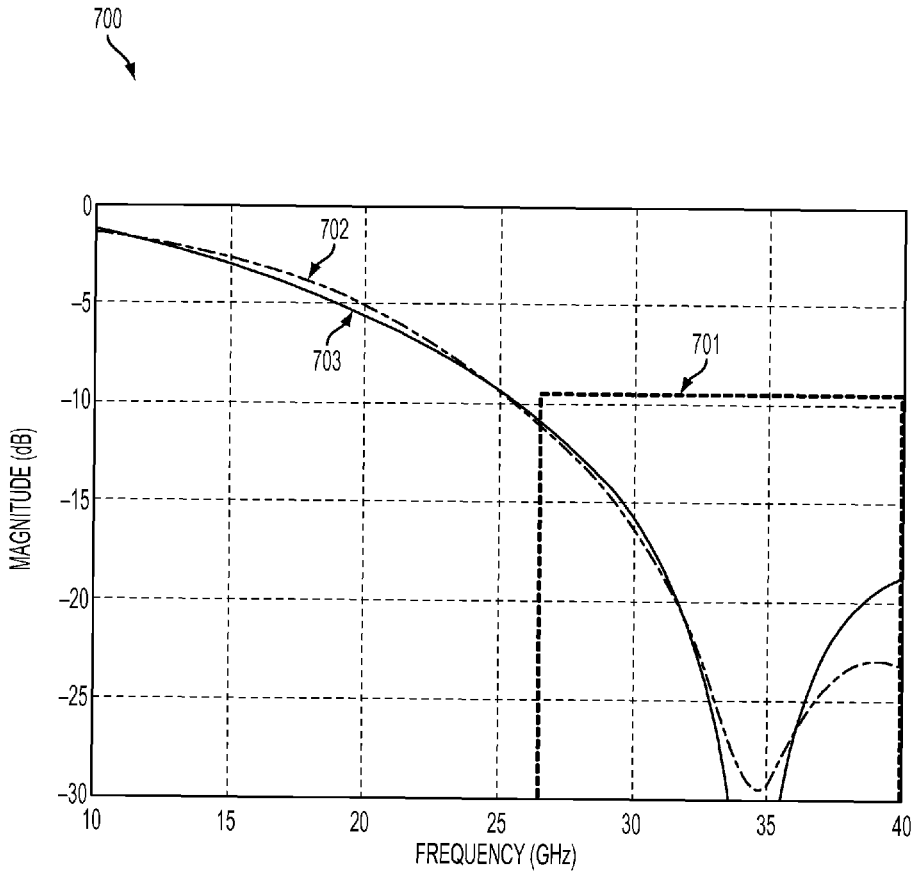
FIG. 7 is a graph illustrating electrical performance of an embodiment of a coaxial-to-stripline transition including a shorted center via.

FIG. 7 illustrates a graph 700 of electrical performance of a coaxial-to-stripline transition including a shorted center via 4 such as was shown in FIGS. 1-3. The Ka band, from about 26 GHz to about 40 GHz, is located within the box 701. Line 702 shows measured magnitude of the signal return loss as a function of frequency for a coaxial-to-stripline transition with a shorted center via, and line 703 shows simulated magnitude of the signal return loss as a function of frequency for a coaxial-to-stripline transition with a shorted center via. Line 702 tracks line 703 relatively closely, and within the Ka band the signal return loss is relatively broadband. The top line of box 701 indicates a 2:1 voltage standing wave ratio (VSWR). Both measured performance (Line 702) and simulated performance (Line 703) demonstrate better than 2:1 VSWR over the entire Ka band for a coaxial-to-stripline transition including a shorted center via 4 such as was shown in FIG. 1-3.

While the disclosure has been described with reference to a preferred embodiment or embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A stripline comprising:

a first ground plane;

a second ground plane;

a first signal trace located between the first ground plane and the second ground plane; and a center via that extends through the stripline and is in electrical contact with the first ground plane and the first signal trace, wherein a top end of the center via is in direct physical contact with the first ground plane, and wherein the center via comprises a coaxial-to-stripline transition that is configured to transmit a signal between a center pin of a coaxial connector that extends into the center via and the first signal trace.

2. The stripline of claim 1, wherein the center via is located within and is in electrical contact with a first tuning pad of the first signal trace, wherein the first tuning pad is located at an end of the first signal trace.

3. The stripline of claim 2, further comprising a plurality of mode suppression vias surrounding the first tuning pad, wherein each of the plurality of mode suppression vias are parallel to the center via, wherein a top of each of the plurality of mode suppression vias is in direct physical contact with the first ground plane, and wherein a bottom of each of the plurality of mode suppression vias is in direct physical contact with the second ground plane.

4. The stripline of claim 3, wherein the plurality of mode suppression vias are arranged around the first tuning pad in a tapered configuration.

5. The stripline of claim 4, wherein the stripline comprises a broadband transmission system, and wherein the plurality of mode suppression vias are arranged around the first tuning pad such that a distance between a mode suppression via and the first tuning pad is shorter for a mode suppression via that is closer to the first signal trace than for a mode suppression via that is farther away from the first signal trace.

6. The stripline of claim 4, wherein the stripline comprises a narrowband transmission system, and wherein the plurality of mode suppression vias are arranged around the first tuning pad such that a distance between a mode suppression via and the first tuning pad is shorter for a mode suppression via that is farther away to the first signal trace than for a mode suppression via that is closer to the first signal trace.

7. The stripline of claim 3, wherein the plurality of mode suppression vias are each in electrical contact with the first ground plane and the second ground plane.

8. The stripline of claim 3, wherein the plurality of mode suppression vias comprise mechanically drilled plated-through-vias.

9. The stripline of claim 1, wherein the first ground plane is separated from the first signal trace by a first dielectric core, and wherein the second ground plane is separated from the first signal trace by a second dielectric core.

10. The stripline of claim 1, wherein the center pin is in electrical contact with the first ground plane through the center via, and wherein a bottom of the center via extends through an annular clearance in the second ground plane such that the center via and the center pin are not in physical contact with the second ground plane.

11. The stripline of claim 1, wherein the first ground plane, the second ground plane, the first signal trace, and the center via are at the same direct current (DC) potential during operation of the stripline.

12. The stripline of claim 1, wherein the center via comprises a mechanically drilled plated-through-via.

13. A stripline comprising:

a first ground plane;

a second ground plane;

a first signal trace located between the first ground plane and the second ground plane; and a center via that extends through the stripline and is in electrical contact with the first ground plane and the first signal trace, wherein a top end of the center via is in direct physical contact with the first ground plane, and wherein the stripline comprises a first stripline, the center via comprises a stripline-to-stripline transition, and further extends through a second stripline, the second stripline comprising a third ground plane, a fourth ground plane, and a second signal trace located between the third ground plane and the fourth ground plane.

14. The stripline of claim 13, wherein the center via is located within and is in electrical contact with a first tuning pad of the first signal trace, wherein the first tuning pad is located at an end of the first signal trace, and further comprising a plurality of mode suppression vias surrounding the first tuning pad, wherein each of the plurality of mode suppression vias extend through the first and second striplines parallel to the center via such that each of the plurality of mode suppression vias is in direct physical contact with each of the first ground plane, the second ground plane, the third ground plane, and the fourth ground plane.

15. The stripline of claim 14, wherein the second stripline comprises a second tuning pad at an end of the second signal trace, wherein the center via is located within and is in electrical contact with the second tuning pad of the second signal trace, and wherein the center via connects the first tuning pad and the second tuning pad, and wherein the plurality of mode suppression vias are arranged around the first tuning pad and the second tuning pad in a tapered configuration.

16. The stripline of claim 13, wherein the center via is in electrical contact and direct physical contact with the fourth ground plane and the second signal trace, and the center via transmits a signal between the first signal trace and the second signal trace.

17. The stripline of claim 13, wherein the first stripline and the second stripline are connected by a bondfilm located between the second ground plane and the third ground plane.

18. The stripline of claim 13, further comprising a window in the second ground plane and the third ground plane, such that the center via extends through the window and the center via is not in physical contact with the second ground plane and the third ground plane.

19. The stripline of claim 13, wherein the first, second, third, and fourth ground planes and the first and second signal traces are at the same direct current (DC) potential during operation of the first and second striplines.

* * * * *